US006292969B1

(12) United States Patent
Supra

(10) Patent No.: US 6,292,969 B1
(45) Date of Patent: Sep. 25, 2001

(54) SWIMMING POOL CLEANER

(75) Inventor: Carl Frederick Wilhelm Supra, Krugersdorp (ZA)

(73) Assignee: Oak Nominees (PTY) LTD, Tortola (VG)

( * ) Notice: Subject to any disclaimer, the term of this patent is extended or adjusted under 35 U.S.C. 154(b) by 0 days.

(21) Appl. No.: 09/379,585

(22) Filed: Aug. 24, 1999

Related U.S. Application Data

(63) Continuation-in-part of application No. 08/915,685, filed on Aug. 21, 1997, now Pat. No. 5,970,557.

(30) Foreign Application Priority Data

Mar. 15, 1999 (ZA) ..... 99/2058

(51) Int. Cl.[7] ..... E04H 4/16
(52) U.S. Cl. ..... 15/1.7
(58) Field of Search ..... 15/1.7; 138/44, 138/103, 106, 177, 178, DIG. 11; 114/222; 210/169

(56) References Cited

U.S. PATENT DOCUMENTS

| | | | | |
|---|---|---|---|---|
| 2,106,427 | * | 1/1938 | Hansson | 138/177 X |
| 3,451,434 | * | 6/1969 | Bauer, Jr. | 138/177 X |
| 3,803,658 | * | 4/1974 | Raubenheimer | 15/1.7 |
| 4,023,227 | | 5/1977 | Chauvier | 15/1.7 |
| 4,133,068 | | 1/1979 | Hofmann | 15/1.7 |
| 4,193,156 | * | 3/1980 | Chauvier | 15/1.7 |
| 4,208,752 | | 6/1980 | Hofmann | 15/1.7 |
| 4,351,077 | | 9/1982 | Hofmann | 15/1.7 |
| 4,611,543 | * | 9/1986 | Collette | 138/44 X |
| 4,642,833 | * | 2/1987 | Stoltz et al. | 15/1.7 |
| 4,769,867 | | 9/1988 | Stoltz | 15/1.7 |
| 5,398,362 | * | 3/1995 | Chauvier | 15/1.7 |
| 5,655,246 | * | 8/1997 | Chang | 15/1.7 |
| 5,706,540 | | 1/1998 | Niewiarowski | 15/1.7 |
| 5,737,791 | * | 4/1998 | Durigon | 15/1.7 |
| 5,794,293 | * | 9/1998 | Hoffinger | 15/1.7 |

FOREIGN PATENT DOCUMENTS

| | | | | |
|---|---|---|---|---|
| 476413 | * | 3/1992 | (EP) | 210/169 |
| 559477 | | 9/1993 | (EP) . | |
| 992076 | * | 10/1951 | (FR) | 210/169 |
| 2430494 | * | 3/1980 | (FR) | 15/1.7 |

* cited by examiner

*Primary Examiner*—Mark Spisich
(74) *Attorney, Agent, or Firm*—Young & Thompson

(57) ABSTRACT

A pool cleaner which includes an integrally moulded body with an elongate float which is embedded in the body and which has a length which is at least 25% of the length of the body. A biasing weight is also embedded in the body on an opposing side of the passage. A flow interrupting device controls water flow through a passage in the body. The float may be separately formed or it may be formed by foaming material from which the body is made.

17 Claims, 6 Drawing Sheets

24

14
26
28
22
48
50

72
70

10
40
94
74
52
56
82
84
64
42
54
98
58
96

SWIMMING POOL CLEANER

RELATED APPLICATION

This specification is a continuation in part of U.S. patent application Ser. No. 08/915,685, filed Aug. 21, 1997 U.S. Pat. No. 5,970,557.

BACKGROUND OF THE INVENTION

This invention relates to a pool cleaner.

The specification of U.S. patent application Ser. No. 08/915,685, U.S. Pat. No. 5,970,557, inter alia describes a pool cleaning device with a unitary one piece body. A number of advantages are associated with a body of this kind.

The aforementioned specification also discloses that a flotation component can be embedded in the body.

SUMMARY OF INVENTION

The present invention is concerned, in the first instance, with a pool cleaner body which lends itself to facilitating the manufacture thereof as an integral structure.

Inherent in the nature of an integral pool cleaner body is the incorporation of a flotation device in the body. The applicant has discovered that this feature can be utilised to produce important benefits and hence a second aspect of the invention relates to characteristics of the flotation means which allow such benefits to be produced.

To achieve the aforementioned and other objects the invention provides a pool cleaner which includes a body, at least one passage which extends through the body with an inlet to the passage and an outlet from the passage at respective opposed ends of the passage, the passage having a minimum cross-sectional area at a position selected from the inlet, the outlet, and a location between the inlet and the outlet, the cross-sectional area of the passage in each direction extending away from the said selected position towards each respective end of the passage monotonically increasing in magnitude.

"Monotonic", as used herein, indicates that the cross-sectional area of the passage at any location is greater than or equal to the cross-sectional area of the passage at a preceding adjacent location, moving away from the position of minimum cross-sectional area. Thus, although the cross-sectional area may not increase along its length, in the indicated direction, it does not decrease. This enables the passage to be formed using a single core which does not have any undercut sections or steps which could impede withdrawal of the core from the passage.

Preferably the said position of minimum cross-sectional area is at the outlet. This enables a single core to be used for forming the passage, as opposed to two cores which are movable together in opposite directions to a moulding position.

The pool cleaner may include a partition which divides the passage into first and second adjacent sub- passages. This however depends on the nature of the cleaner.

The partition, when used, may be formed integrally with the remainder of the body. This may be done by appropriately shaping the core. Preferably though the partition is formed separately from the body and is engaged with formations in the body thereby to divide the passage into the said first and second adjacent sub-passages.

The pool cleaner may include a chamber adjacent the inlet which is in communication with the passage, a fluid-flow interrupting device of any appropriate kind in the chamber, and a closure member with at least one aperture which is releasably engaged with the body to enclose the device in the chamber.

The cleaner may include flotation means which may be elongate, extending in the general direction of the passage, and which has a length which is in excess of 25% of the length of the body, and which is preferably of the order of 50% of such length.

In a variation of the invention the flotation means comprises a plurality of flotation components which are respectively positioned at spaced intervals from each other in an array which extends in the general direction of the passage between the inlet and the outlet.

The flotation means may be formed separately and may then be embedded in the body during manufacture of the body. According to a preferred aspect of the invention however the flotation means is formed integrally with the body by foaming material from which the body is made during manufacture of the body.

As used herein "foaming" includes any mechanism or technique whereby the material of the body is directly caused to foam, by means of chemical action, or the material is foamed by the introduction of a foaming agent of any appropriate kind or is aerated, for example by the injection of a suitable gas, including air.

The flotation means is preferably located on what in use is an upper side of the body, on one side of the passage, and biasing means which may be in the form of a body section is then located on a lower side of the body on a directly opposing side of the passage.

BRIEF DESCRIPTION OF THE DRAWINGS

The invention is further described by way of examples with reference to the accompanying drawings in which.

DESCRIPTION OF PREFERRED EMBODIMENTS

Figure 1:
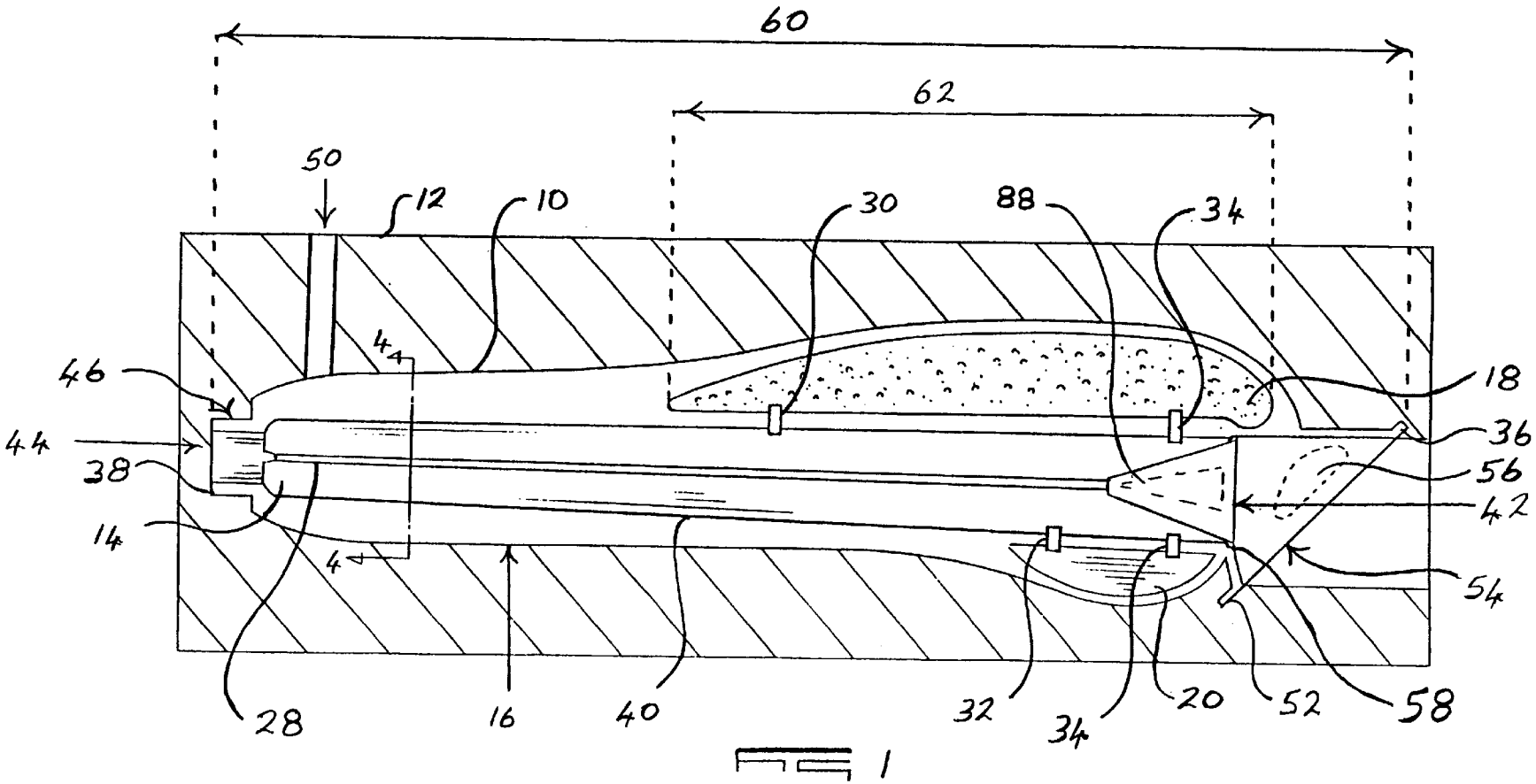
FIG. 1 is a side view of a pool cleaner according to the invention in the process of manufacture.

FIG. 1 of the accompanying drawings illustrates a pool cleaner body 10 in the process of manufacture. The body is formed inside a first mould member 12 which is made from a suitable material and in which is located a second mould member 14 referred to herein as a core. The mould member 12 is made from at least two interengageable halves. To a considerable extent FIG. 1 is schematic for it is intended to show the principles of the process of manufacture. The manner in which the mould members are made and engaged with one another are aspects which are known in the art and hence are not further described herein.

The core 14 is precisely positioned inside a cavity 16 which defines an outer shape of the body 10. This is done using techniques which are known in the art. A suitable plastics material such as polypropylene is then injected into the cavity around the core 14 to form the body 10. Once the body has set the body is removed from the mould member 12 and the core 14 is extracted. All this is done using techniques which are known in the art.

An objective of the present invention is to provide a pool cleaner body which is formed in a single moulding process so that, as far as possible, the body has a unitary type construction. In other words components which make up the body are not separately fabricated and then secured to one another by means of fasteners, clip formations and the like. It is important, particularly from the economic point of view and from the durability point of view, to be able to make a pool cleaner body which has a unitary construction. Production costs are low and the ability of the body to withstand vibration and similar shock effects, which may be encountered during use, is enhanced.

It is known that a pool cleaner, during use, should adopt a designed orientation. For this purpose use is made of a flotation component which imparts buoyancy to the body and a biasing member or weight which increases the density of a portion of the body. Hitherto, to the applicant'knowledge, pool cleaners of which the applicant is aware make use of a flotation component which has a "localised effect". For example in U.S. Pat. No. 4,023,227 the flotation component is circular, viewed from the side. In U.S. Pat. No. 4,351,077 the flotation component is spherical. The applicant has now discovered that the use of an elongate flotation component holds two important benefits. Firstly the orientation of the cleaner, which is essential for good working and particularly when the cleaner is first immersed in water, is maintained with a surprising degree of accuracy. An unexpected result, the reasons for which are not fully understood, is that weights which are normally attached to a suction hose connected to the cleaner may be dispensed with. Such weights are traditionally used in a manner which is determined empirically and which depends inter alia on the depth of the swimming pool in which the cleaner is used.

A second benefit is that the applicant has noticed that the pool cleaner body is highly maneuverable during use. The pool cleaner body is able to rotate in a manner which reduces the likelihood that the pool cleaner will become trapped at awkward locations under water, for example at corners or steps.

To achieve the aforementioned benefits the pool cleaner body 10 includes an elongate flotation component 18 which, in this example of the invention, is prefabricated from a suitable foamed material such as polystyrene or foamed polyurethane or any equivalent material. The pool cleaner body also includes a lead weight or bias component 20 embedded in the body.

Figure 2:
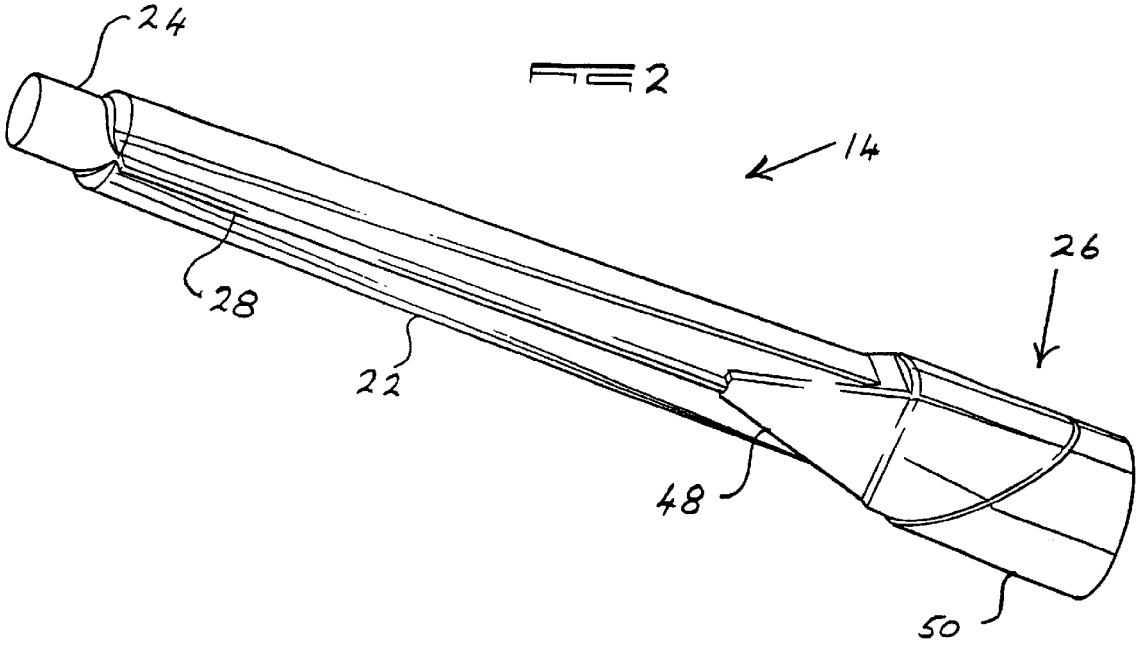
FIG. 2 is a perspective illustration of a core used in the process of manufacture.

The core 14 is shown in perspective in FIG. 2. The core has a central section 22 which is elongate and which has a circular cross-section, a spigot 24 at one end of the central section and an enlarged chamber-forming section 26 at an opposed end of the central section. Two ribs 28 project outwardly from the central section 22 and extend between the spigot 24 and the section 26. The ribs are on opposed sides of the central section. Only one rib is visible in FIG. 1 and FIG. 2.

The central section of the core is formed with a first pair of recesses 30 on one side thereof and a second set of recesses 32 on an opposing side thereof (see FIG. 1). Before the core is located in the mould member 12 small plastic spigots 34 are inserted into the respective recesses. Protruding ends of the spigots are engaged with complementary holes in the flotation component 18 and the lead weight 20, respectively. In this way the flotation component and the lead weight are precisely positioned relatively to the core. The core is then located in the mould member 12.

The core extends between opposed ends 36 and 38 of the body and, once removed, leaves a passage 40 which extends between these ends. The passage has an inlet 42 and an outlet 44. The passage, at the outlet, has a region 46 of minimum cross-section. Proceeding in the length of the passage from the outlet to the inlet the cross-sectional area of the core 14, and hence of the passage, increases monotonically. Thus, at any location, the cross-section of the passage is greater than or equal to the cross-section of the passage at an immediately preceding location. The core also has no steps or discontinuities which could form undercut regions, and the passage is therefore similarly formed. The cross-sectional area of the spigot 24, and hence of the region 46, is substantially constant. The central section 22 is formed with a taper of 2° and consequently the cross-sectional area of the central section increases gradually moving from left to right in FIG. 1.

The inlet 42 does not include a step or undercut formation which could prevent retraction of the core. The core, as is evident particularly from FIG. 2, has outwardly extending V-shaped formations 48, at the section 26, which ultimately form internal walls of a chamber of the pool cleaner.

To the right of the section 26 the core has a solid section 50 which is mainly provided for purposes of utility to enable the core to be handled and correctly located inside the member 12.

As has been indicated plastic material, such as polypropylene 50 of a suitable grade, is injected into the volume formed between opposing surfaces of the cavity 16 and the core 14. The material sets around the core, the flotation component and the lead weight. Once the material has set the body and the contained core 14 are removed from the member 12. The core is then extracted from the body by withdrawing it through the inlet 42. Although the core is closely surrounded by the material from which the body is formed, and consequently there is an initial resistance to relative movement between the core and the body, once the core has been moved to the right relatively to the body (referring to FIG. 1) the monotonic cross-sectional nature of the core and, more particularly, the fact that the central section 22 is tapered, means that only a small degree of relative movement between the body and the core is necessary for the core to be moved freely away from the body.

When the core is withdrawn the spigots 34 are sheared. The spigots are, as has been noted, anchored to the body and to the flotation component 18 and the lead weight 20. The spigots do not have substantial strength and the relative movement referred to is sufficient to break the spigots so that the core can be withdrawn from the body. The sections of the spigots which remain inside the body are simply left there.

The invention thus provides a method of constructing a pool cleaner body with an embedded flotation component and bias component.

Adjacent the inlet 42 the core and mould member 12 are shaped to define an outwardly extending flange 52 which circumscribes a mouth 54 which is on, what in use is, an upstream side of the pool cleaner body. The material of the body between the inlet 42 and the mouth 54 is formed with two opposing holes 56, indicated in dotted outline in FIG. 1. The inlet has a surrounding shoulder 58.

The body has a length 60 and the flotation component 18 has a length 62, measured in the general direction of the passage.

The length 62 is preferably in excess of 25% of the length 60 and more particularly is at least 50% of the length 60. It has been found, totally fortuitously, that an elongate flotation component of this type imparts considerable stability to the pool cleaner body and also enables the pool cleaner body to take up the correct orientation or attitude when it is immersed in water, particularly when it is first placed in the water. Another surprising finding has been that the manouverability of the cleaner, as measured by its ability to rotate during movement, about its longitudinal axis, is enhanced. This assists the cleaner in extricating itself from difficult positions within a pool in which it is located and also increases the degree of random movement of the pool cleaner.

The flotation component 18 is on an upper side of the pool cleaner body in use while the lead weight 20 is on a lower side of the pool cleaner body, diametrically opposing the flotation component. Thus buoyancy is exerted on the body by the flotation component over a substantial portion of the length of the body while the biasing action of the lead weight 20 is exerted at a localised position, towards a lower end of the cleaner, which is on a lower side of the cleaner.

Figure 3:
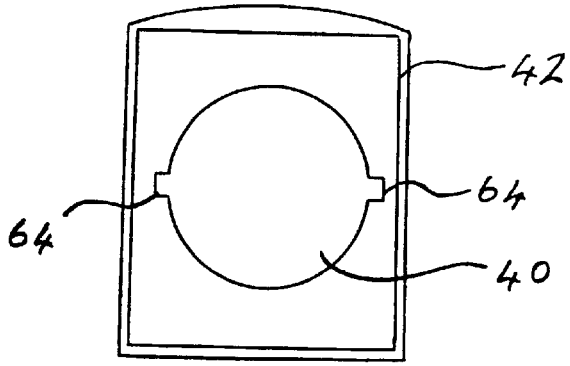
FIG. 3 is an end view of a mouth of the pool cleaner shown in FIG. 1.

Although the body 10, formed in the manner described, is integral and has a unitary construction it is not complete in the sense that it is not yet ready for use. FIG. 3 is an end view of the cleaner illustrating only the inlet 42, which is of rectangular cross-section, and the passage 40 which has a circular cross-section. Slots 64 are formed on diametrically opposed sides of the passage by the two ribs 28 on the core.

Figure 4:
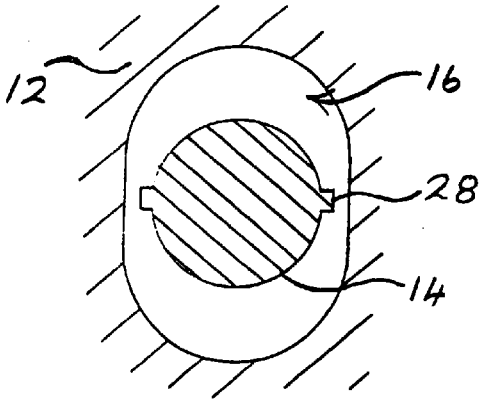
FIG. 4 is a cross-sectional view of a body of the pool cleaner taken on a line 4—4 in FIG. 1.

FIG. 4 is a cross-sectional view of the cavity 16 and core 14 taken on the line 4—4 in FIG. 1.

Figure 6:
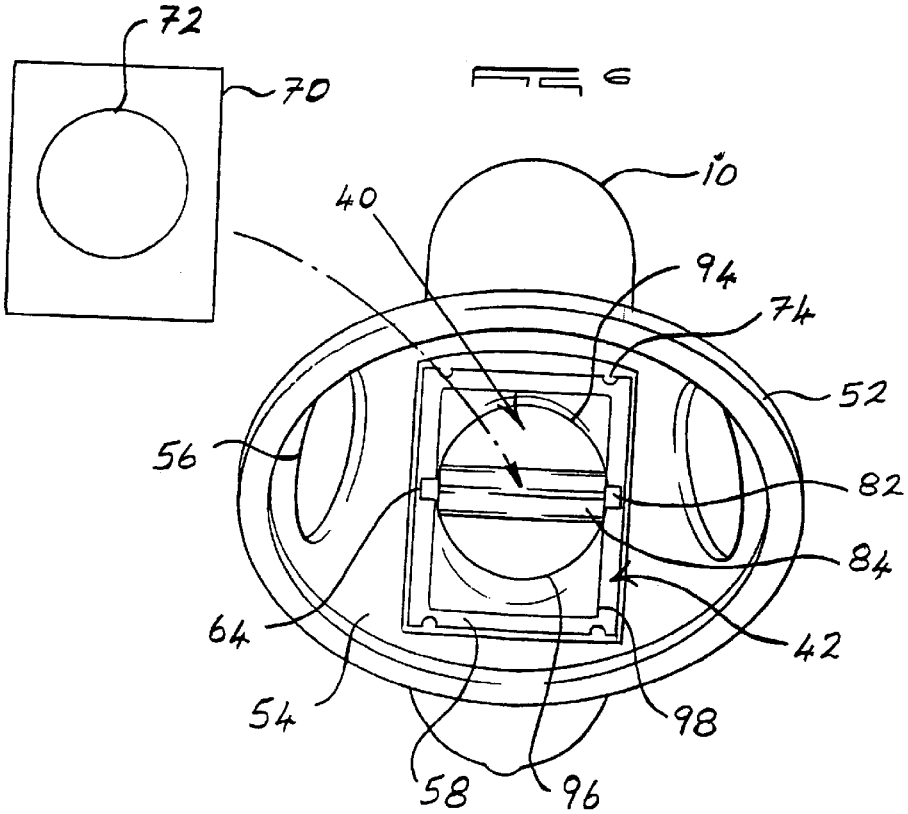
FIG. 6 is an end view of the body of the pool cleaner with a cover plate in an exploded position.

FIG. 6 is an end view of the cleaner and illustrates the flange 52 which surrounds the mouth 54 and the inlet 42. FIG. 6 also illustrates a closure or cover plate 70 which is separately moulded and which includes a centrally located hole or aperture 72. The body 10 has four relatively small inwardly extending flexible projections 74 surrounding the inlet 42. The cover plate 70 can be inserted through the mouth and can be seated on the shoulder 58 by depressing the projections 74 to allow the cover plate to pass the projections. The projections then revert to the illustrated positions to keep the cover plate in position firmly fixed to the pool cleaner body. The cover plate can easily be removed simply by inserting a finger through the hole 72 and tugging on the cover plate. This is a highly useful feature for it enables dirt or debris which may have been caught inside the passage to be accessed and removed. The cover plate can then be re-engaged with the pool cleaner body.

Figure 5:
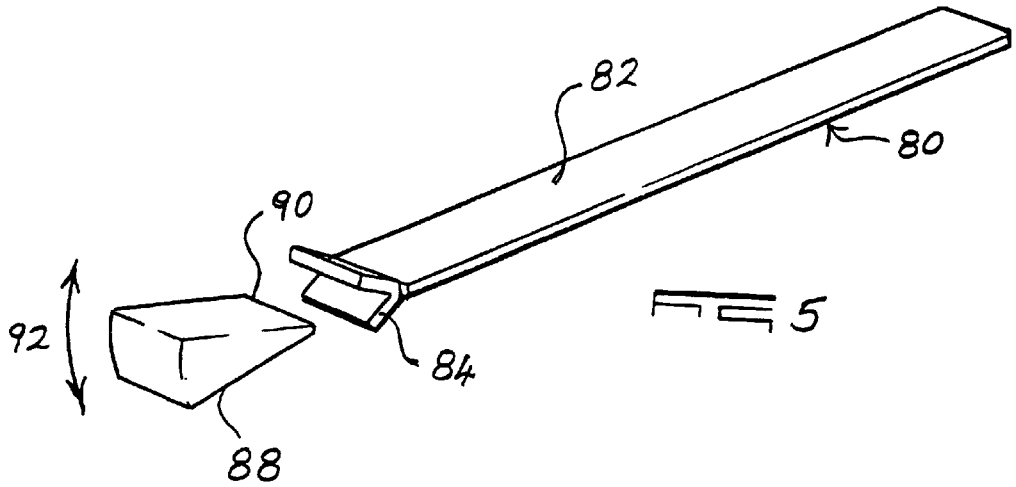
FIG. 5 is a perspective view of a partition and hammer used in the pool cleaner of the invention.

FIG. 5 shows a pre-formed partition 80 which includes an elongate section 82 of rectangular dimensions and a V-shaped groove formation 84 at one end of the section. A flow interrupting device which is in the form of a V-shaped hammer 88 has a leading end 90 which is locatable in the groove formation 84. The hammer is capable of moving to and fro as is indicated by means of an arrow 92, relatively to the partition 80, between limiting positions which are defined by arms of the V-shaped groove.

The partition 80 is designed to fit into the slots 64 in the inner wall of the passage 40. This is done after the core has been removed from the body. The partition is slid into the passage with opposing longitudinal edges being directly engaged in the respective slots. The passage is thereby divided into first and second adjacent sub-passages 94 and 96 respectively. The V-shaped groove 84 is moved to a position which is in register with the apices of the recessed formations which are formed by the V-shaped formations 48. The hammer 88, which is shown in dotted outline in FIG. 1, is thereby constrained in its movement between opposing internal inclined walls of a chamber 98.

When the cover plate 70 is engaged with the body 10 the hammer is thereby held captive inside the valve chamber.

The pool cleaner is used in a manner which is known in the art and which is therefore not further described in detail herein. A skirt of any flexible material is engaged with the outwardly projecting flange 52 and a suction hose is coupled to the outlet 44 using a swivel connector of any appropriate type. When the pool cleaner is immersed in water suction is applied to the suction hose and to the passage 40 by means of an external pump, not shown. The pump causes water to flow through the inlet 42 to the outlet 44. The water flow causes the hammer 88 to oscillate to and fro inside the valve chamber 98. The water flow alternatively surges through the two sub-passages 94 and 96 which are formed by the partition 80 which divides the main passage 40 into two D-shaped sub-passages with the partition forming a common wall between the D-shaped sub-passages.

Figure 7:
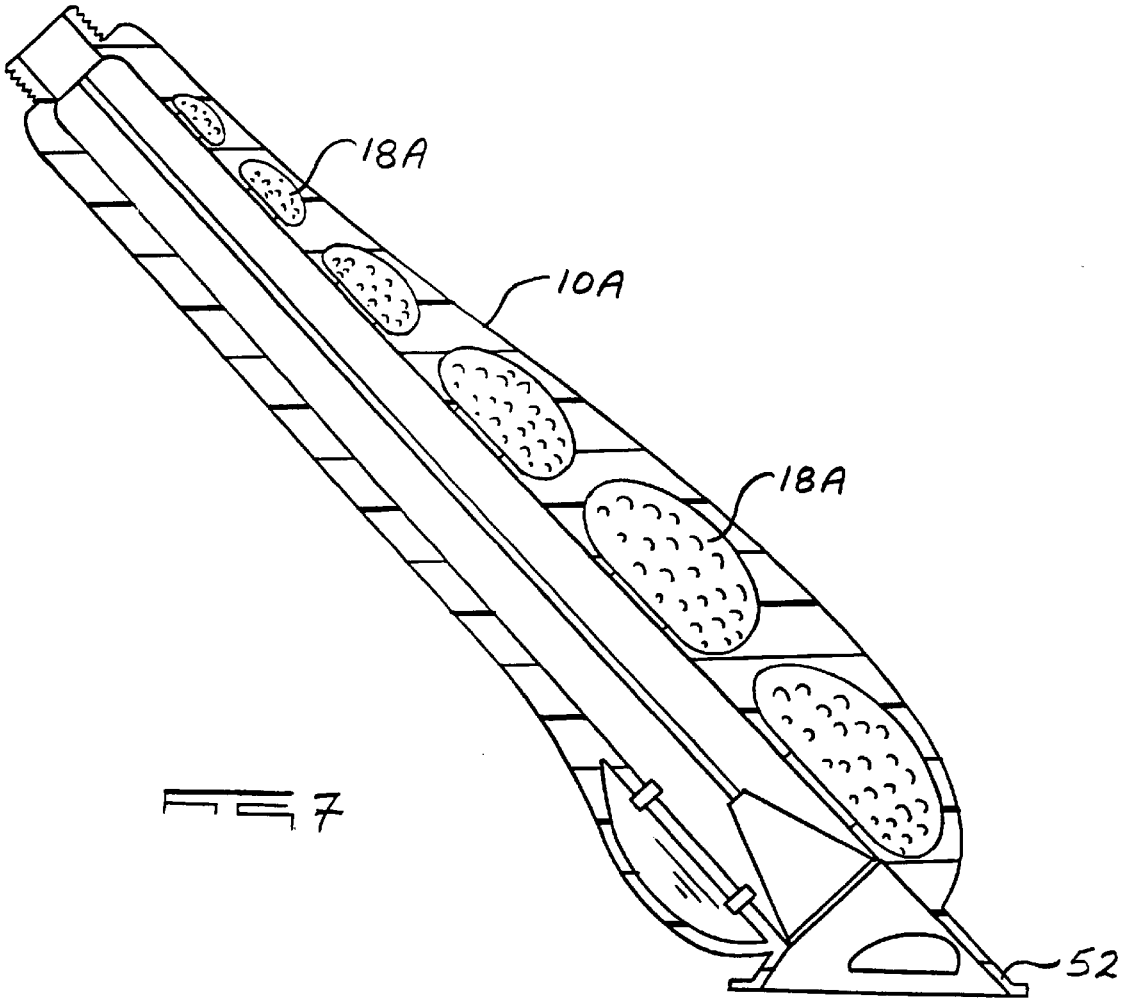
FIG. 7 is a view of a pool cleaner body which is similar to that shown in FIG. 1 but which includes a variation of the invention.

The feature of maneuverability of the pool cleaner which is achieved through the use of an extended flotation component, as has been described by referring to the component 18 in FIG. 1, can be achieved in another manner. For example, referring to FIG. 7, a plurality of separately formed and relatively smaller flotation components 18A are embedded in a body 10A of a pool cleaner according to a variation of the invention. The flotation components are of a size and number which take into account the relative densities of the material of the pool cleaner body and the density of the flotation components so that adequate buoyancy is imparted to the body over its length. The components 18A may be of the same size or differ in size. The important aspect in this regard is to provide buoyancy for the body over a substantial portion of its length in order to achieve the benefits which have been referred to hereinbefore. The remaining features of the pool cleaner body 10A are substantially similar to corresponding features of the body 10 and hence have not been elaborated on.

Figures 8, 9:
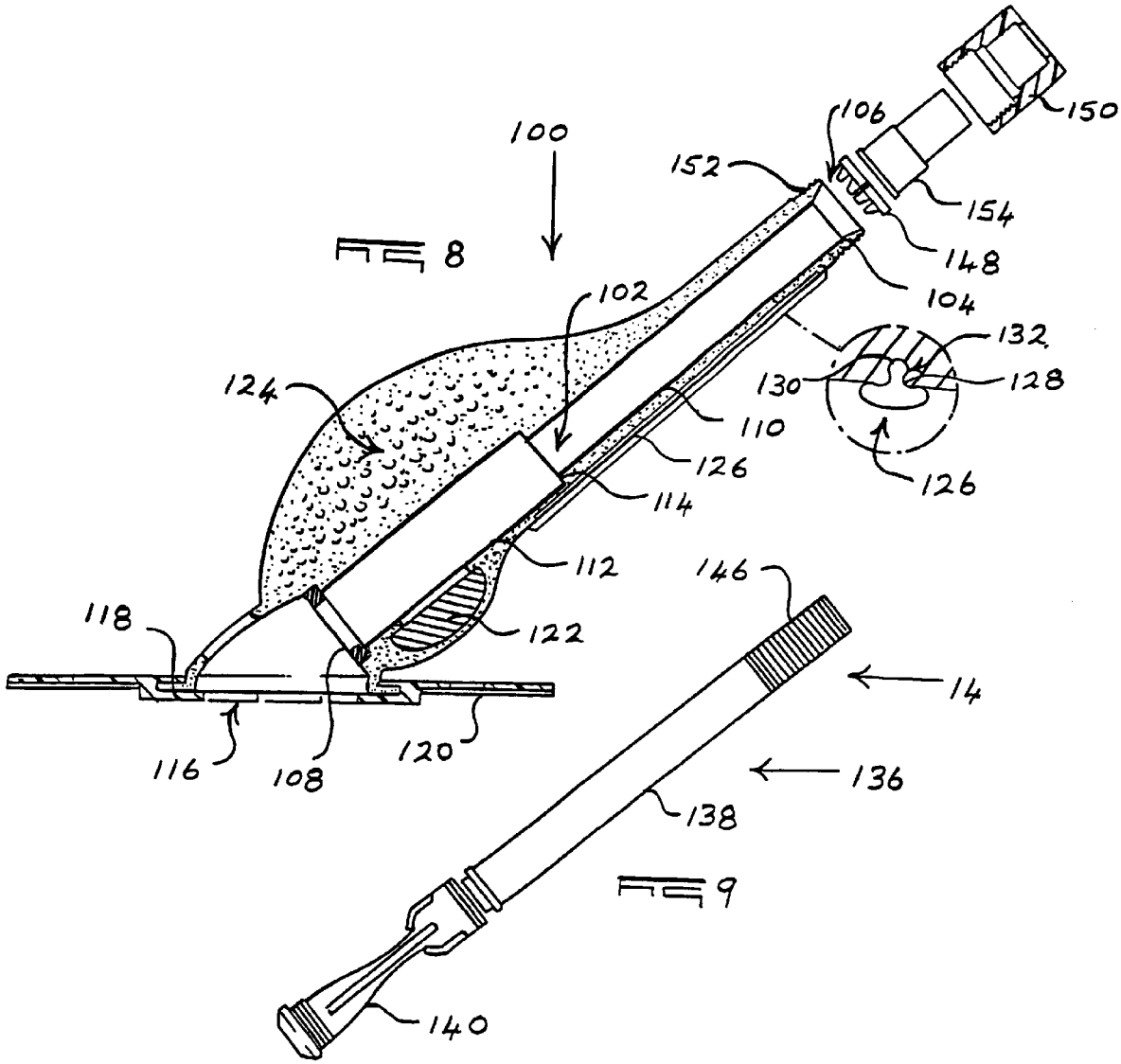
FIG. 8 is a side view of a pool cleaner according to a different form of the invention.
FIG. 9 illustrates a flow interrupting device which is used in the pool cleaner of FIG. 8.
Figure 10:
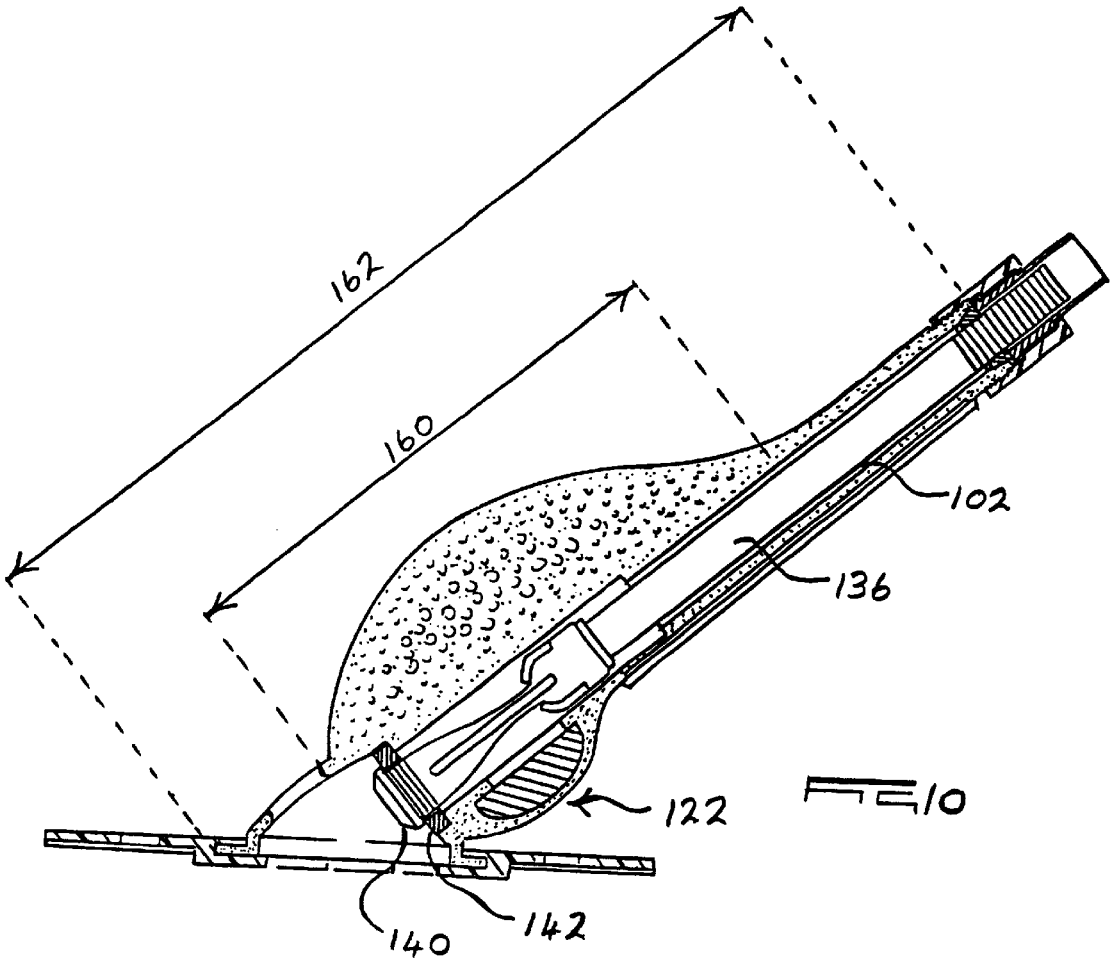
FIG. 10 shows the components of FIGS. 8 and 9 assembled.

FIGS. 8 to 10 illustrate the principles of the invention applied to the construction of a pool cleaner which makes use of a different type of flow interrupting device. FIG. 8 shows a pool cleaner body 100 which is moulded, substantially in the manner which has described in connection with FIG. 1, and which has a unitary one piece body. The body includes an internal passage 102 which has a region 104 of minimum cross-section. This region is close to an outlet 106 at one end of the body. Between the region 104 and the outlet 106 the passage is flared and hence increases monotonically moving to the right.

The passage at an opposing end has an inlet 108 and the cross-sectional area of the passage moving from the region 104 to the inlet 108 increases monotonically. The passage has a first section 110 with a first taper which gradually increases the cross-sectional area of the passage and a second section 112 which is also tapered so that, moving from right to left, the cross-sectional area of the section increases. A shoulder 114 is at a junction of the first and second sections.

The body has a mouth 116 which is surrounded by an outwardly extending flange 118. A flexible skirt 120, of known construction, is engaged with the flange.

A biasing weight 122 is embedded in the body, using the technique which has been described in connection with FIG. 1. In the aforementioned respects the pool cleaner body 100 is similar in concept to the pool cleaner body 10 shown in FIG. 1.

The body 100 also includes a flotation component 124 which may be separately formed and which is then embedded in the body during manufacture of the body. However the applicant has discovered that the component 124 may be formed integrally with the body by foaming the material from which the body is made. It has been noted that the body is formed from a plastics material and this may be foamed in a number of ways. The body may be foamed by the introduction of a foaming agent which causes cavities or gas bubbles to be produced. This feature has been found to manifest itself particularly in those regions of the body where the thickness of the body is greater than a predetermined amount, for example of the order of 4 mm. Consequently by keeping this aspect in mind it is possible, through judicious design, to ensure that the plastics material, which is injected into the moulds used for making the body, is caused to solidify substantially without any foaming action taking place over those portions of the body which define walls which are relatively thin bounding the flow passage 102. By increasing the dimensions of the body relatively to the flow passage a larger volume is formed in which foaming action takes place and, in this way, the component 124 can be formed integrally with the material of the body. The foaming action may be initiated in various ways which are known in the plastics industry. For example use may be made of a cellular plastics material with the cellular construction being produced by the effect of a gas which is injected into the plastics material before it has set or which is generated during the injection process by means of chemical action. Thus, by manipulating the characteristics of the moulding process, it is possible to form the body with sections that are less dense than the remaining sections of the body and each such less dense section is, in effect, a flotation element. On the other hand with gas injection techniques of plastics material it is known that the plastic material, when it comes into contact with a mould surface, particularly a heated mould surface, forms a section which is relatively free of gas. By manipulating the characteristics of the mould it is possible to ensure that a substantial portion of the body is formed with a substantial amount of cells which impart to such portion a less dense characteristic. An opposing side of the pool cleaner body which carries the lead weight 122 is made more dense and hence is not foamed.

The body has a removable bumper strip 126 which is made from a material such as polyurethane which is abrasion and wear-resistant. The inset drawing to FIG. 8 shows the cross-section of the strip. The bumper strip has an elongate rib 128 with a bulbous end 130 which is engageable with a press fit into a slot 132 of corresponding dimensions formed in a lower longitudinal edge of the body.

FIG. 9 illustrates a flow interrupting mechanism 136 which is of known construction and which includes a tube 138 and a diaphragm valve 140. As shown in FIG. 10 the device 136 is insertable into the passage 102 through the inlet 108. The diaphragm 140 seats on a shoulder 142 and a remote end 144 of the tube which is formed with gripping formations 146 is then engaged with a compression ring 148 which is encompassed by a union nut 150 which is threadedly engaged with a threaded boss 152 of the body around the outlet 106. A swivel connector 154 extends from the nut and is connectable to a suction hose, not shown.

When suction is applied to the connector 154 water flow through the diaphram valve 140 causes the valve to open and close, in a manner which is known in the art, and the pulsating action of the water flow causes the pool cleaner to move in a random manner over a surface which is to be cleaned.

The pool cleaner shown in FIG. 10 possesses similar advantages to what have been described in connection with the other embodiments, namely the length 160 of the elongate flotation component is considerably in excess of 25% of the length 162 of the pool cleaner body, between the inlet and the outlet, and the pool cleaner thus possesses considerable maneuverability during use. A second factor is that the body is of a unitary construction.

The foamed flotation component is particularly useful for it eliminates a separate moulding step. Another important benefit is that by using substantially dense plastics material, and by careful control of the volumes in which foaming takes place, or does not take place, the volume which is occupied by the weight 122 can be formed with solid plastics material, which provides the required bias, and the weight can be eliminated. It may however be necessary to enlarge the solid plastics section to obtain a mass which is equivalent to the mass of the lead weight which is replaced by the plastics section.

The minimum cross-sectional area of the passage, in the body of the cleaner, is preferably at one end of the passage for this requires a single core. If the region of minimum cross-sectional area is at an intermediate position in the passage then the monotonic increase in cross-sectional area is in two directions, each towards a respective end of the passage, and two cores are required, each inserted into the mould member 12 from a different side and in opposing directions.

What is claimed is:

1. A pool cleaner comprising:

a unitary one piece body with first and second non-coaxial passages that extend through the body with an inlet to the first and second passages and an outlet from the first and second passages at respective opposed ends of the passages, each of the first and second passages being selected from the following two constructions, (1) passage A with a minimum cross-sectional area at a position between the inlet and the outlet and with a cross-sectional area monotonically increasing in magnitude in each direction extending away from the position towards each respective end of the passage A, and (2) passage B with a minimum cross-sectional area at one end of the passage B and with a cross-sectional area monotonically increasing in magnitude in a direction extending away from the one end of the passage B towards an opposed end of the passage B;

a chamber adjacent to the inlet; and a water flow interrupting device in the chamber.

2. The pool cleaner according to claim 1, further comprising a formation at the outlet for connection of the first and second passages to a suction hose.

3. The pool cleaner according to claim 1, wherein the first and second passages are separated by a planar longitudinal partition.

4. The pool cleaner according to claim 3, wherein the partition is formed separately from the body and engages grooves interior to the body thereby to form part of each of the first and second passages.

5. The pool cleaner according to claim 1, further comprising a closure member, with at least one aperture, which is releasably engaged with the body to enclose the water flow interrupting device in the chamber.

6. The pool cleaner according to claim 1, further comprising flotation means which is elongate, extending in the general direction of the first and second passages, and which has a length which is in excess of 25% of the length of the body.

7. The pool cleaner according to claim 6, wherein the flotation means is formed integrally with the body by foaming material from which the body is made during manufacture of the body.

8. The pool cleaner according to claim 1, further comprising flotation means comprising a plurality of flotation components which are respectively positioned at spaced intervals from each other in an array which extends in the general direction of the first and second passages between the inlet and the outlet.

9. The pool according to claim 1, further comprising flotation means which is located on what in use is an upper side of the body on one side of the first and second passages, and which includes biasing means which is located on a lower side of the body on a directly opposing side of the first and second passages.

10. The poll cleaner according to claim 1, further comprising biasing means which is located on a lower side of the body and wherein the biasing means is formed by a solid portion of the body.

11. The pool cleaner of claim 1, wherein the first and second passages have the same length.

12. A pool cleaner comprising:

a unitary, one-piece body with a hollow passageway through said body that opens to an outlet at one end of said body and to an inlet at another end of said body, said passageway having longitudinal grooves on opposing interior sides;

a generally planar longitudinal partition in said passageway with opposite edges that are carried in said grooves, said partition dividing said passageway into first and second passages that each extends a length of said passageway, each of said first and second passages having a minimum cross-sectional area at an end thereof and a cross-sectional area that monotonically increases towards another end thereof, an end of said partition at said inlet having a generally V-shaped groove; and a generally wedge-shaped water flow interrupter at said inlet, an apex of said wedge-shaped interrupter fitting into said V-shaped groove, said wedge-shaped interrupter being movable to interrupt water flow alternately to said first and second passages, said wedge-shaped interrupter having a range of motion defined by said V-shaped groove.

13. The pool cleaner of claim 12, further comprising a cover plate that holds said wedge-shaped interrupter in said passageway.

14. The pool cleaner of claim 12, wherein the first and second passages have the same length.

15. A pool cleaner comprising:

a unitary, one-piece body with a hollow passageway through said body that opens to an outlet at one end of said body and to an inlet at another end of said body, said passageway having longitudinal grooves on opposing interior sides;

a generally planar longitudinal partition in said passageway with opposite edges that are carried in said grooves, said partition dividing said passageway into first and second passages that each extends a length of said passageway, each of said first and second passages having a minimum cross-sectional area at a position between said inlet and said outlet and a cross-sectional area that monotonically increases towards ends thereof from the position, an end of said partition at said inlet having a generally V-shaped groove; and a generally wedge-shaped water flow interrupter at said inlet, an apex of said wedge-shaped interrupter fitting into said V-shaped groove, said wedge-shaped interrupter being movable to interrupt water flow alternately to said first and second passages, said wedge-shaped interrupter having a range of motion defined by said V-shaped groove.

16. The pool cleaner of claim 15, further comprising a cover plate that holds said wedge-shaped interrupter in said passageway.

17. The pool cleaner of claim 15, wherein the first and second passages have the same length.

* * * * *